US009051699B2

(12) United States Patent
Rowland

(10) Patent No.: US 9,051,699 B2
(45) Date of Patent: Jun. 9, 2015

(54) PEDESTRIAN AND VEHICLE BARRIER

(71) Applicant: FLETCHER BUILDING HOLDINGS LIMITED, Auckland (NZ)

(72) Inventor: Ian Philip Rowland, Rangiora (NZ)

(73) Assignee: FLETCHER BUILDING HOLDINGS LIMITED, Auckland (NZ)

( * ) Notice: Subject to any disclaimer, the term of this patent is extended or adjusted under 35 U.S.C. 154(b) by 37 days.

(21) Appl. No.: 13/746,655

(22) Filed: Jan. 22, 2013

(65) Prior Publication Data

US 2014/0203229 A1 Jul. 24, 2014

(51) Int. Cl.
*E01F 15/00* (2006.01)
*E01F 15/04* (2006.01)

(52) U.S. Cl.
CPC ..... *E01F 15/043* (2013.01); *Y10T 29/49716* (2015.01)

(58) Field of Classification Search
USPC ..... 256/1, 13.1, 24, 65.01, 65.02, 65.07, 256/65.12, 73, DIG. 5; 248/235, 295.11; 182/113; 52/36.5, 36.6, 653.1, 653.2, 52/831, 832
See application file for complete search history.

(56) References Cited

U.S. PATENT DOCUMENTS

| | | | | |
|---|---|---|---|---|
| 2,579,797 | A * | 12/1951 | Churchfield et al. | 119/28.5 |
| 3,388,892 | A | 6/1968 | Case | |
| 3,468,430 | A * | 9/1969 | Lawman | 211/182 |
| 3,837,754 | A * | 9/1974 | Malcik | 403/217 |
| 4,126,403 | A | 11/1978 | Sweeney | |
| 4,148,477 | A * | 4/1979 | Larson | 472/91 |
| 4,759,161 | A * | 7/1988 | Kucyk et al. | 52/99 |
| 4,926,592 | A * | 5/1990 | Nehls | 52/98 |
| 5,125,194 | A | 6/1992 | Granger | |
| 5,535,555 | A * | 7/1996 | Boyd et al. | 52/99 |
| 5,664,905 | A | 9/1997 | Thompson | |
| 6,390,436 | B2 | 5/2002 | Barnes | |
| 6,398,192 | B1 | 6/2002 | Albritton | |
| 6,467,747 | B1 | 10/2002 | Ellsworth | |
| 6,488,268 | B1 * | 12/2002 | Albritton | 256/13.1 |
| 7,104,720 | B2 | 9/2006 | Humphries | |
| 7,220,077 | B2 | 5/2007 | Humphries | |
| 7,234,687 | B2 | 6/2007 | King | |

(Continued)

FOREIGN PATENT DOCUMENTS

| | | |
|---|---|---|
| AU | 2012101048 | 8/2012 |
| DE | 10059080 | 6/2002 |

(Continued)

OTHER PUBLICATIONS

Ezy-Guard Ingal Civil Products Smart, Product Manual, Released in Jan. 2011.

(Continued)

*Primary Examiner* — Michael P Ferguson
*Assistant Examiner* — Nahid Amiri
(74) *Attorney, Agent, or Firm* — Jacobson Holman, PLLC.

(57) ABSTRACT

A pedestrian and vehicle barrier system is provided for attaching handrails onto vehicle guardrail barriers. The system comprises an elongate support post member with a slot at a bottom end, to be slid telescopically over a guardrail support post, and sleeved such that it is substantially restricted from moving laterally and/or rotating relative to the guardrail support post. Movement may be further restricted by fasteners. Handrails or other auxiliary barriers may be attached to a top end of the support post member.

12 Claims, 9 Drawing Sheets

(56) References Cited

U.S. PATENT DOCUMENTS

| | | | | |
|---|---|---|---|---|
| 7,748,681 | B2 | 7/2010 | Dent | |
| 7,878,485 | B2 | 2/2011 | Conway | |
| 8,083,433 | B2 * | 12/2011 | Neusch | 404/6 |
| 8,215,619 | B2 | 7/2012 | Leonhardt | |
| 8,246,013 | B2 | 8/2012 | Mauer | |
| 2003/0094603 | A1 | 5/2003 | Lerch, Jr. | |
| 2008/0224114 | A1 * | 9/2008 | Cheng | 256/19 |
| 2008/0226391 | A1 | 9/2008 | Phillips | |
| 2010/0192482 | A1 | 8/2010 | James | |

FOREIGN PATENT DOCUMENTS

| | | |
|---|---|---|
| EP | 0708206 | 4/1996 |
| EP | 0924348 | 6/1999 |
| EP | 1136624 | 9/2001 |
| EP | 1496160 | 1/2005 |
| EP | 1612333 | 1/2006 |
| FR | 2564498 | 11/1985 |
| GB | 2315510 | 2/1998 |
| JP | 10-018255 | 1/1998 |
| JP | 2002-069955 | 3/2002 |
| KR | 101007728 | 1/2011 |

OTHER PUBLICATIONS

Transit New Zealand Bridge Guardrail, http://www.nzta.govt.nz/resources/bridge-manual/index.html, published Jun. 2003.

* cited by examiner

PEDESTRIAN AND VEHICLE BARRIER

BACKGROUND OF THE INVENTION

The present invention relates to roadway safety barriers, particularly to a roadway safety system having both a vehicle guardrail barrier and a pedestrian handrail. More particularly, the present invention relates to a pedestrian handrail system for attaching to vehicle semi-rigid guardrail system.

Roadway guardrail systems or crash barriers are commonly installed along highways and roads to protect any vehicles accidently leaving the road, and/or prevent them from crashing directly onto pavements, surrounding roads, or oncoming traffic. Several existing guardrail systems are designed to help absorb and dissipate some of the vehicle's energy as it impacts the barrier. This is achieved by the combination of tensile, flexible rails and the bending or shearing resistance of support posts. Impact energy may additionally be absorbed by movable or frangible components (and/or joints between components) which absorb energy as they fracture, move or deform.

An example of a guardrail system with rails which are designed help to absorb and dissipate impact energy is disclosed in U.S. Pat. No. 7,878,485.

As guardrail systems are frequently installed between a road and a pavement, an object of the present invention is to improve pedestrian safety by providing a pedestrian vehicle barrier (PVB) system. The present PVB system comprises a handrail system incorporated with vehicle guardrail systems. The handrail attachment may also include fence bars or panels for increased safety, for example to prevent young children and animals from accessing the road.

It is a further object of this invention to provide a handrail attachment system for vehicle guardrail systems which does not unduly interfere with the ability of the vehicle guardrail system to dissipate impact energy and perform as intended.

It is a further object to provide a handrail system for retrofitting existing guardrail installation.

BRIEF SUMMARY OF THE INVENTION

In one aspect the invention broadly consists in an auxiliary support post for attaching to a vehicle guardrail system comprising:

an elongate member with a wall forming an at least partially closed section, the elongate member having a top end and a bottom end, and a slot in the wall located toward the bottom end and extending longitudinally.

According to another aspect the slot is open ended.

According to another aspect the auxiliary support post further including an aperture in the wall located towards the bottom end and opposite the slot.

According to another aspect the auxiliary support post further including at least one fence panel.

According to another aspect the fence panel includes a series of spaced bars.

According to another aspect the wall defines a fully closed section, save for the slot and any local features.

According to another aspect the auxiliary support post further including at least one handrail positioned towards the top end.

According to another aspect the invention broadly consists in an auxiliary support post assembly for attaching to a vehicle guardrail support post comprising:

at least one auxiliary support post of any one of the previous clauses, at least one auxiliary rail section for attaching to the auxiliary support post, wherein the auxiliary support post is slid telescopically over the guardrail support post to sleeve around the guardrail support post such that the auxiliary support post cannot be separated from the guardrail support post other than by translation along the direction of the longitudinal axis of the guardrail support post.

According to another aspect the auxiliary support post is secured on the guardrail support post via a fastener extending through the slot.

According to another aspect the fastener compresses the auxiliary support post onto the guardrail support post.

According to another aspect the auxiliary support post assembly further including an aperture in the wall located opposite the slot for accommodating the fastener, and wherein at least a portion of the aperture is longitudinally aligned with at least a portion of the open-ended slot.

According to another aspect the fastener comprises a bolt, a nut and a washer.

According to another aspect in the assembled state, the washer is positioned within the aperture and substantially in the plane of the wall, and the nut is fastened on the bolt to directly or indirectly bear against wall portions surrounding the slot.

According to another aspect the auxiliary support post assembly further comprising a vehicle guardrail supported on the guardrail support post.

According to another aspect the auxiliary support post assembly further comprising a blockout positioned between the vehicle guardrail and the guardrail support post, and wherein, in the assembled state, the aperture is located adjacent the blockout, the washer is positioned substantially within the aperture and substantially in the plane of the wall, and the nut is fastened on the bolt to directly or indirectly bear against wall portions surrounding the slot.

According to another aspect the assembly further includes a fence panel.

According to another aspect the auxiliary support post does not substantially interfere with the ability of the guardrail support post to deform upon impact to the rail.

According to another aspect the auxiliary support post does not impede the fastener from sliding along mounting apertures on the guardrail support posts upon impact to the rail.

According to another aspect the invention broadly consists in a pedestrian vehicle barrier (PVB) system, comprising:

a plurality of auxiliary support post assemblies according to any one of the previous clauses.

According to another aspect the PVB system is capable of withstanding loads of up to 1.5 kN/m, in accordance with AS/NZS 1170.1:2002.

According to another aspect the invention broadly consists in a method of retrofitting an auxiliary barrier, onto an existing roadway guardrail system comprising a rail mounted via fasteners onto a plurality of guardrail support posts, the method comprising:

removing the fasteners which attach the rail to each guardrail support post via a mounting aperture ("guardrail post aperture") on each guardrail support post, sliding an auxiliary support post over the top of each guardrail support post until a slot in the auxiliary support post is aligned with the guardrail post aperture, and replacing the fasteners.

According to another aspect the guardrail support posts are according to any one of the previous clauses.

According to another aspect the method results in at least one assembly according to any one of the previous clauses.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "comprising" as used in this specification and claims means "consisting at least in part of". When interpreting statements in this specification and claims which include that term, the features, prefaced by that term in each statement, all need to be present but other features can also be present. Related terms such as "comprise" and "comprised" are to be interpreted in the same manner.

The entire disclosures of all applications, patents and publications, cited above and below, if any, are hereby incorporated by reference.

BRIEF DESCRIPTION OF THE DRAWINGS

Preferred forms of the present invention will now be described with reference to the accompanying drawings in which.

DESCRIPTION OF PREFERRED EMBODIMENTS

Figure 1A:
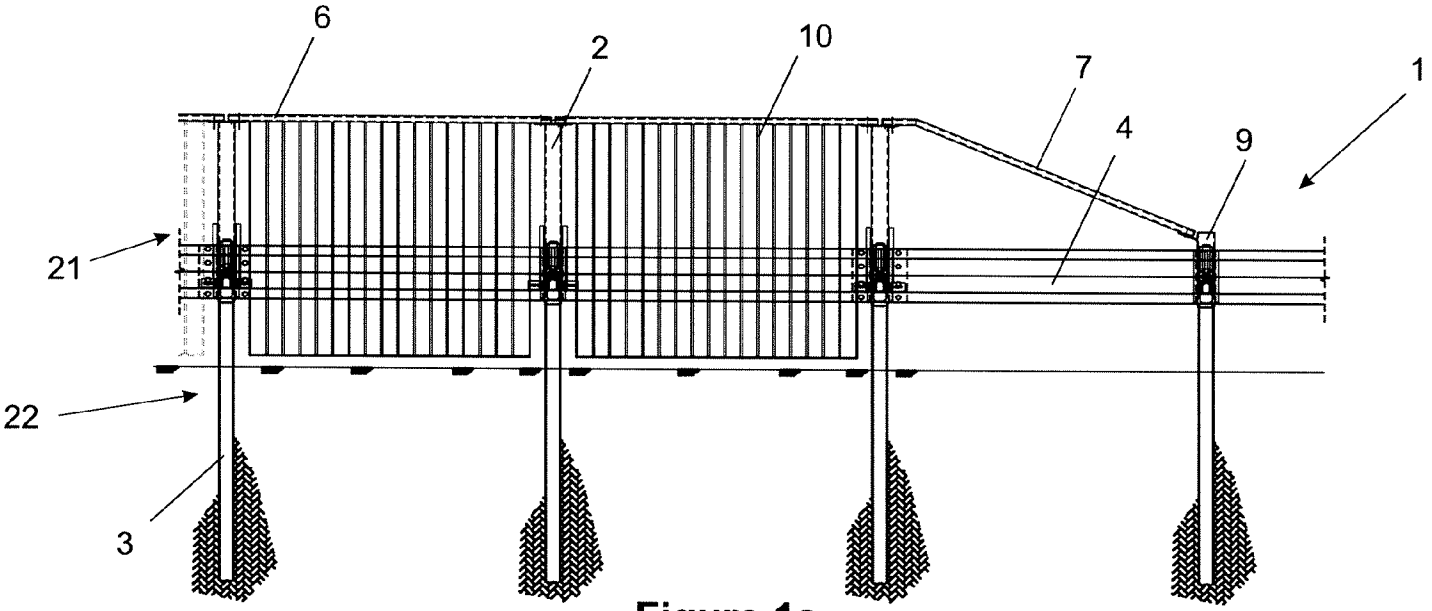
FIG. 1*a* shows an elevation view of the preferred embodiment of the PVB system, including fencing panels.

FIG. 1*a* shows an elevation view of the preferred embodiment of a pedestrian and vehicle barrier (PVB) system 1, installed between a pedestrian access path (e.g., pavement, footbridge) and a vehicle access path (e.g., road, vehicle bridge, highway). The front elevation view of FIG. 1*a* corresponds to the viewpoint taken from the pedestrian access, looking towards the vehicle access. The PVB system 1 comprises a vehicle guardrail system, generally denoted by 22, and an auxiliary barrier attachment system (e.g.: an handrail, fence, screen or other barrier), generally denoted by 21.

While the following description describes the invention as a "handrail" (and associated members), it is to be understood that term "handrail" (and "handrail support" etc) includes other auxiliary barriers such as fences, screens or other barriers.

Figure 1B:
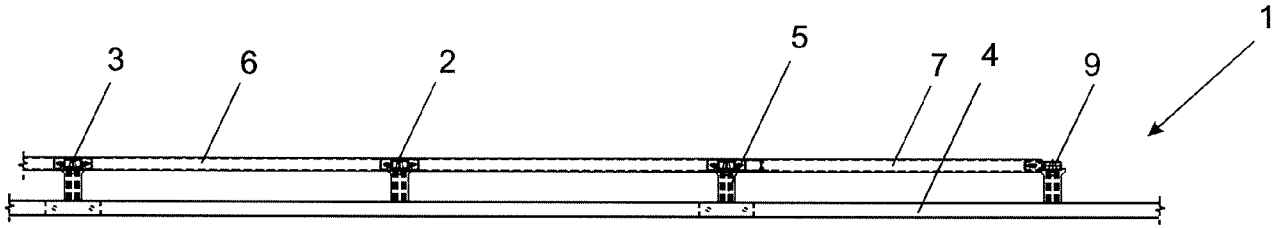
FIG. 1*b* shows a plan view corresponding to FIG. 1*a*.

The vehicle guardrail system 22 includes guardrail support posts 3 and rail sections 4. The rails 4 may be attached to the guardrail support posts 3 via blockouts 5 (shown in FIG. 1*b*). The blockouts 5 space the rails 4 apart from the guardrail support posts 3, which prevents vehicles from colliding into the guardrail support posts. Blockouts 5 preferably also space the handrails 6 apart from the rails 4 to maintain a distance between pedestrians on the handrail side of the PVB system and vehicles on the guardrail side of the PVB system.

Handrail attachment system 21 preferably includes elongate handrail support posts 2, intermediate handrails 6, terminal handrails 7, and terminal handrail support posts 9. The handrail system 21 preferably also includes fencing panels or rails 10.

Figure 2B:
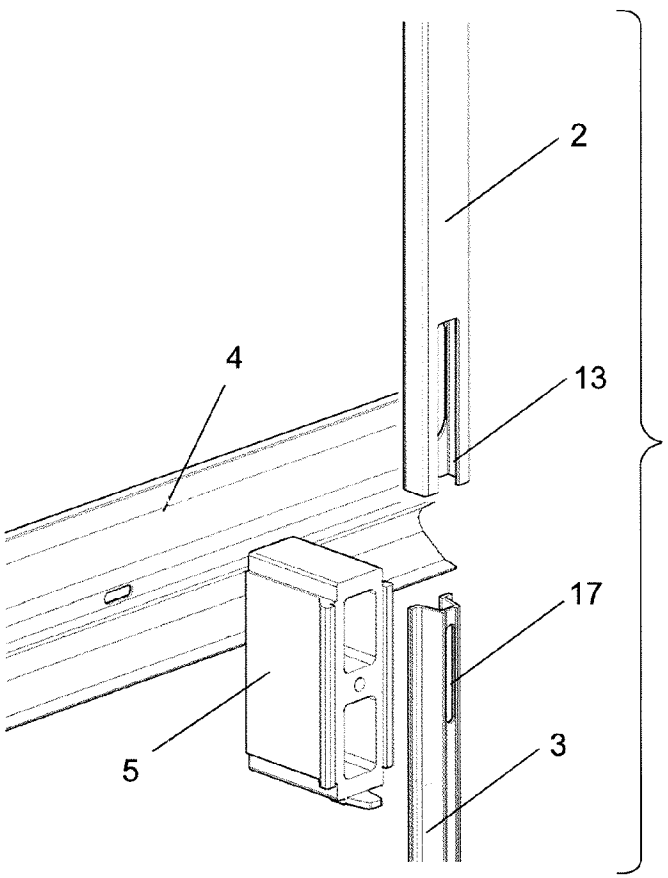
FIG. 2*b* is a schematic exploded view of a section of the PVB system corresponding to a rear view of the setup shown in FIG. 2*a*.
Figure 2A:
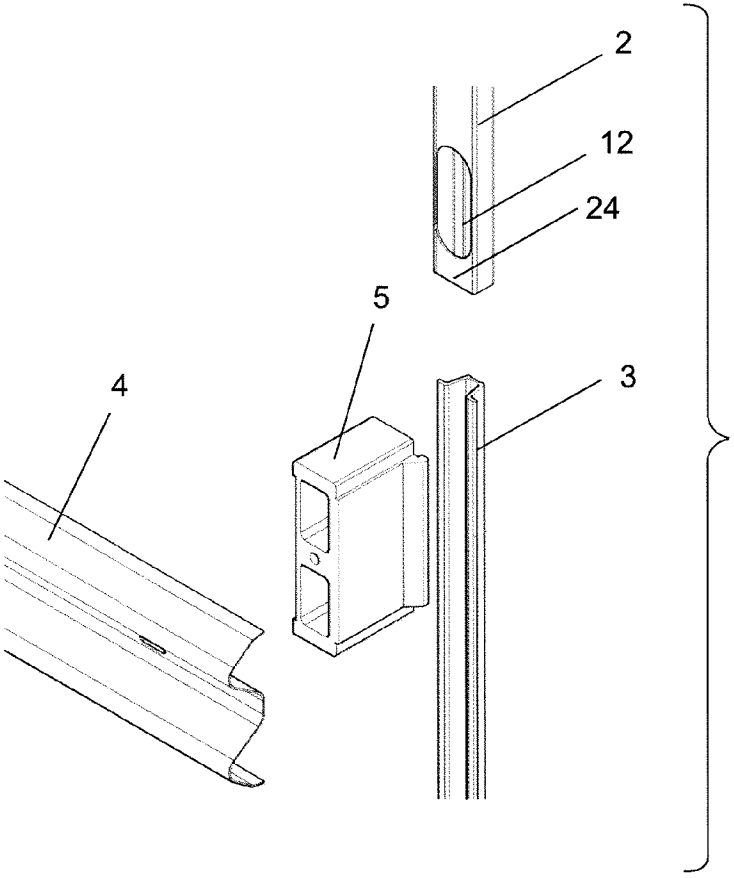
FIG. 2*a* is a schematic exploded view of a section of the PVB system, highlighting the connection between the vehicle barrier and a handrail support post.

FIGS. 2*a* and 2*b* show schematic exploded views of a section of the PVB system, highlighting the connection between a section of the rail 4, guardrail support post 3 and handrail support post 2.

Rail 4 is shown here as a W-beam rail. However, other types of beams may be used, for example thrie beam, box beam, corrugated or non-corrugated rails. Similarly, while guardrail support post 3 is shown as a U-channel post, alternative embodiments of this invention may be used to accommodate other guardrail support posts such as I-beam, C-shaped, Z-shaped or S-shaped posts. Handrail support post 2 is shaped and sized so that it can sleeve over guardrail support post 3.

Importantly, the cross sectional configuration of the handrail support post 2 is at least partially closed such that once sleeved around the guardrail support post 3, the two posts interlock and cannot be separated, except via translation along the longitudinal direction of the guardrail support post 3 (i.e., by sliding the handrail support post 2 back up over the top of guardrail support post 3). It will be appreciated that the degree to which the section of handrail support post 2 needs to be partially closed (in order to interlock with the guardrail support post 3), will depend on the shape of the guardrail support post 3. The term, partially closed in this context refers to the general shape of the cross section of the handrail support post 2, not including any local features such as apertures, lugs or end caps etc.

The cross sectional shape of the handrail support post 2 is preferably rectangular (as shown) or square to sleeve over the U-channel guardrail support post by sliding the handrail support post 2 down over the top of the guardrail support post.

Preferably, the fit is such that while in the sleeved position, the handrail support post 2 is substantially restricted from moving laterally and/or rotating relative to the guardrail support post 3. Lateral and/or rotational movement may additionally restricted by the fastener components described in more detail below.

The handrail support post 2 may alternatively have other cross sectional shapes (e.g., circular, triangular) depending on the shape of the guardrail support post. Additionally, the handrail support post 2 may not have a fully enclosed cross section, as long as the handrail support post 2 can still be sleeved around the guardrail support post 3, and can only be separated from the guardrail support post 3 via translation along the longitudinal axis of the guardrail support post 3.

Handrail support post 2 is preferably sized so that it may be installed easily by sliding over the top of guardrail support post 3. Preferably, handrail support post 2 is sized to provide some friction fit between the handrail support post 2 and guardrail support post 3. Handrail support post 2 has a slot 13 at the back of the post and located towards the bottom. Preferably, the slot is open-ended to make assembly easier. Alternatively, the slot may be closed.

Preferably, handrail support post 2 also has an aperture (or slot) 12 in the front. Aperture 12 is preferably wider than open-ended slot 13. Open-ended slot 13 is preferably closed at the top of the slot but open at the base of handrail support post 2.

The example guardrail system 22 shown here corresponds to the system disclosed in U.S. Pat. No. 7,878,485, which is hereby incorporated by reference in its entirety. However, it should be understood that the handrail system of this present invention may be used to convert any guardrail system (provided the system comprises guardrail support posts and rail sections) into a PVB system, particularly guardrail systems featuring frangible or deformable components.

This example guardrail system includes an aperture 17 along each guardrail support post 3 for mounting rail 4 onto each guardrail support post 3. Upon vehicular impact to the rail 4, the connected guardrail support posts 3 deform, dissipating some of the vehicle's energy. Upon sufficient impact, the rail 4 can move relative to the guardrail support posts 3 to dissipate more energy, since the fastener which attaches the rail 4 to the guardrail support posts 3 can slide within and along the apertures 17. As detailed below, the handrail system of this present invention is designed to so that it does not significantly interfere with energy dissipating features of existing guardrail systems.

Figure 3:
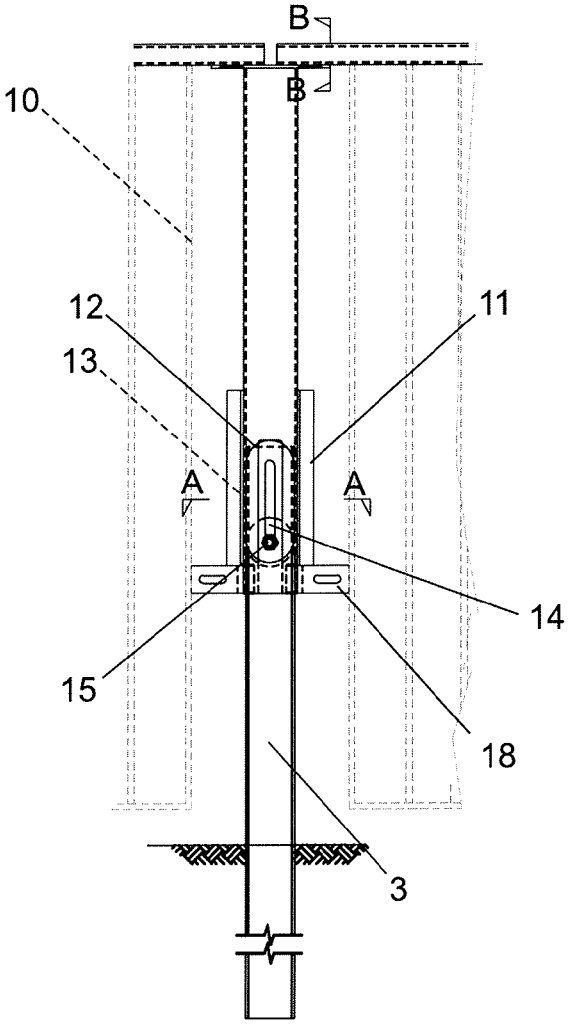
FIG. 3 shows a detailed view of the connection between the handrail and guardrail system, with rail and blockout omitted for clarity.
Figure 4A:
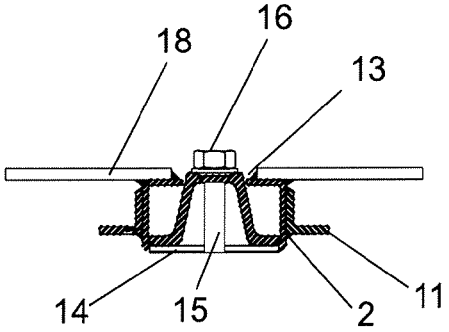
FIG. 4*a* is a cross sectional view of the handrail and guardrail attachment taken along section line A-A in FIG. 3.
Figure 4B:
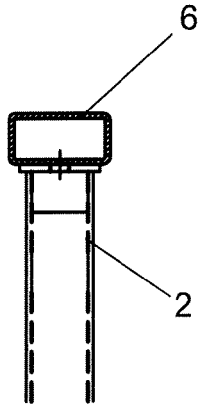
FIG. 4*b* is a cross sectional view of the handrail taken along section line B-B in FIG. 3.
Figure 11:
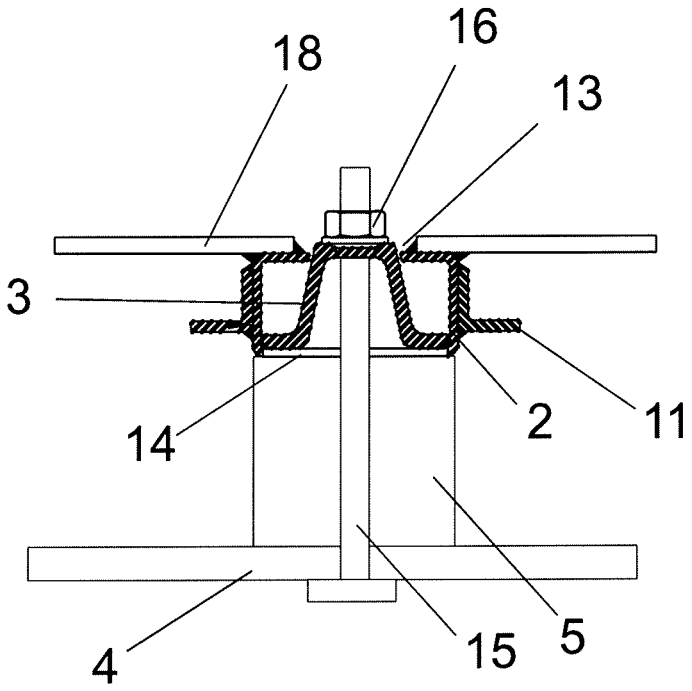
FIG. 11 is a cross sectional schematic of the handrail and guardrail attachment, similar to FIG. 3, but with rail and blockout included.

To install the handrail system to an existing guardrail system, the fasteners which attach the rail 4 to each guardrail support posts 3 are firstly removed. The fastener may include a bolt 15, nut 16 and washer 14. A handrail support post 2 is then slid over the top of each guardrail support post 3. The handrail support post 2 is pushed down until aperture 12 and slot 13 are aligned with corresponding apertures 23, 24 and 17 in rail 4, blockout 5 and guardrail support post 3 respectively. The aligned positioning of the aperture and slots is shown in FIGS. 3, 4 and 11. The fastening components 15, 16 and 14 are then replaced.

For retrofitted installations, the original fastening components used for the vehicle guardrail system are preferably used to secure the handrail system onto the existing vehicle guardrail system. For alternative new installations (i.e., where both the vehicle guardrail system and handrail system are new), preferably only a single set of fastening components is used at each guardrail support post 3, to secure the handrail support post 2 to the guardrail support post 3, as well as the guardrail support post 3 to the rail 4 and/or blockout 5.

Importantly, the aperture 12 is wide enough to fit around washer 14. Similarly, slot 13 is wide enough to fit around the bolt 15 and/or nut 15. This is shown more clearly in the cross sectional views in FIGS. 4*a* and 11. FIG. 4*a* is a simplified cross sectional view corresponding to FIG. 3, with the rail 4 and blockout 5 omitted. FIG. 11 is a schematic cross sectional view with rail 4 and blockout 5 shown.

Washer 14 fits within aperture 12, and is substantially within the plane of aperture 12. A portion of the guardrail support post 3 fits within, and is aligned with slot 13. In this example, it is the face corresponding to the bottom of the U-shaped cross-section of guardrail support post 3.

In an alternative embodiment, the entire cross section of guardrail support post 3 may lie within the cross-sectional envelope of the handrail support post 2, so that only nut 16 is within and aligned with slot 13.

It is important that the aperture 12 and slot 13 fit around the fastening components, so that the handrail support post 2 is not directly sandwiched between nut 16 and blockout 5. This ensures that the fastener can still slide within and along apertures 17, largely unimpeded by the handrail support post 2, when the guardrail is hit by a vehicle. Upon sufficient impact, the fastener can slide along the length of slot 13 and out of the open end of slot 13. In high speed and/or high energy collisions, the web 24 between aperture 12 and the bottom of handrail support post 2 may additionally fracture, detaching the handrail support post from the guardrail system.

Additionally, aperture 12 and slot 13 are preferably positioned near the base of the handrail support posts 2 so that the handrail support posts sleeve only over the top portion of the guardrail support posts 3. This allows the guardrail support posts 3 to deform upon impact, largely unimpeded by the handrail support posts.

Figure 12:
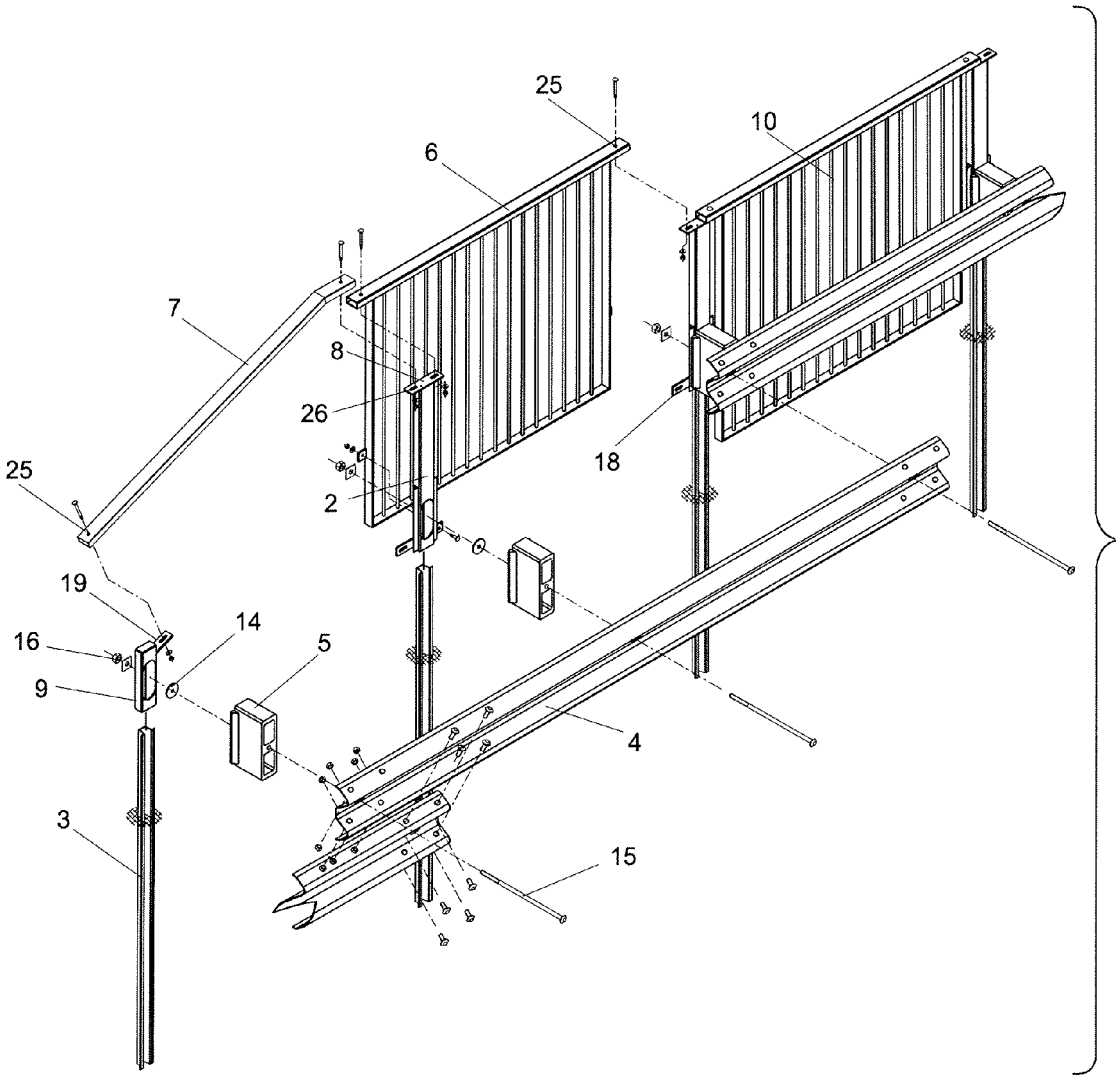
FIG. 12 is an exploded view of the preferred embodiment of the PVB system.

Intermediate handrails 6 are preferably attached substantially perpendicularly to the handrail support posts 2. FIG. 12 shows how the handrails may be attached to the handrail support posts via fasteners through apertures 25 at the ends of handrails 6 and apertures 26 on intermediate plate brackets 8 extending perpendicularly at the top of handrail support posts 2. Alternatively, intermediate handrail sections 6 may be permanently welded onto handrail support posts 2.

Figure 9A:
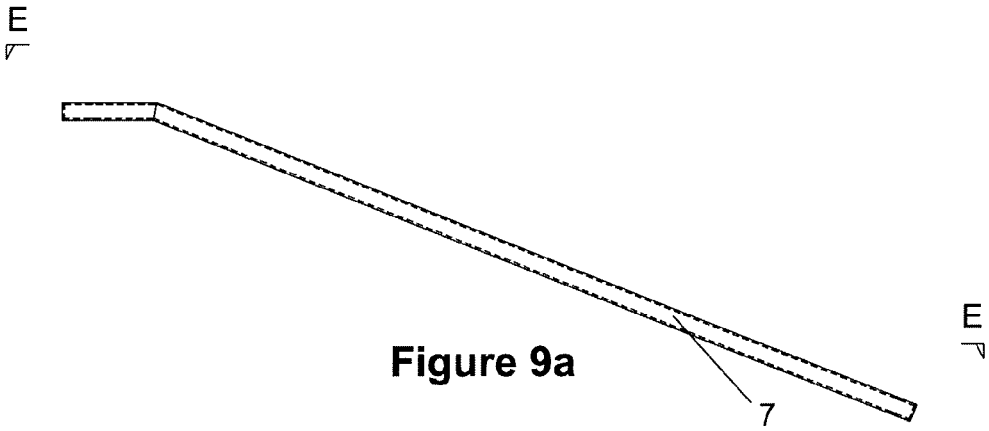
FIG. 9*a* is an elevation view of a terminal handrail.
Figure 9B:
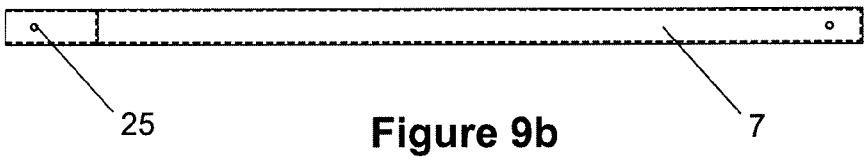
FIG. 9*b* is a cross sectional view of the terminal handrail taken along section line E-E of FIG. 9*a*.

Preferably, the handrails taper down towards the height of the guardrail support posts at the end regions of the PVB system. This will prevent accidents involving pedestrians and/or vehicles colliding with horizontally protruding handrail sections. Terminal handrail support posts 9, which are shorter than the regular handrail support posts 2 may be used for this purpose. As shown in FIGS. 7*a*, 7*b*, 7*c* and 7*d*, the terminal handrail support posts 9 include terminal plate brackets 19 fixed at an obtuse angle relative to the top face of the terminal handrail support posts 9. The angled terminal handrail sections 7 (shown in FIGS. 9*a* and 9*b*) may be attached to the terminal plate brackets 19, to form the tapered handrail terminal regions.

In the preferred embodiment shown in FIGS. 1 and 12, the handrail system includes fence panels or rails 10 extending from handrails 6 to a distance at or near ground level. This additional security measure prevents children from accessing the road. The fence panels 10 are preferably integrally formed with the handrails 6 or pre-attached to the handrails 6 for easier installation. Alternatively, separate fence panels may be attached to the handrails 6 and/or handrail support posts 2 after installation of handrail sections 6 onto the handrail support posts.

Figure 5:
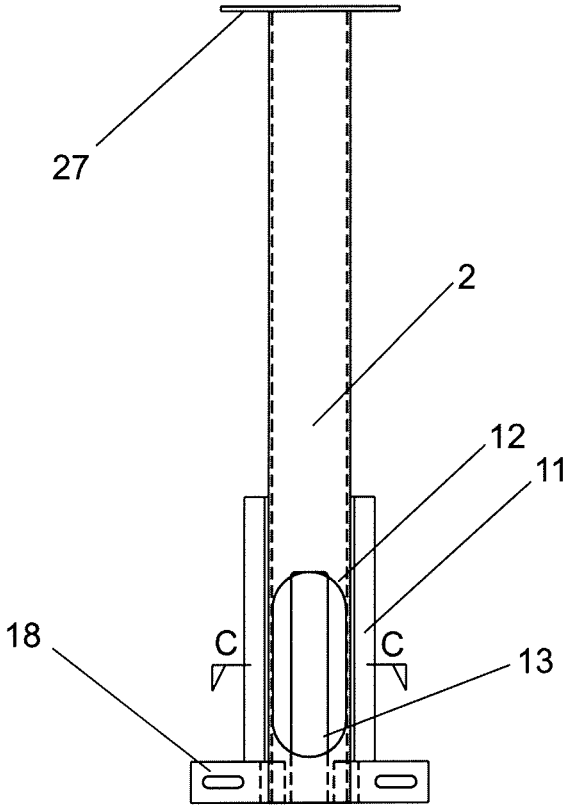
FIG. 5 is a detailed view of an intermediate handrail support post.
Figure 6:
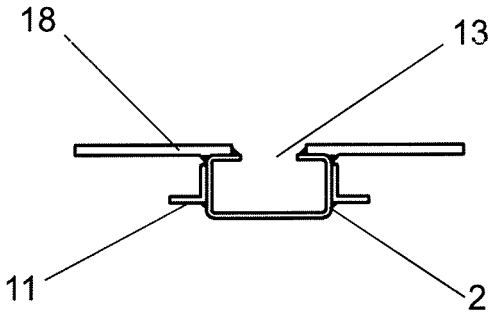
FIG. 6 is a cross sectional view of the intermediate handrail support post of FIG. 5 taken along section line C-C.
Figure 7A:
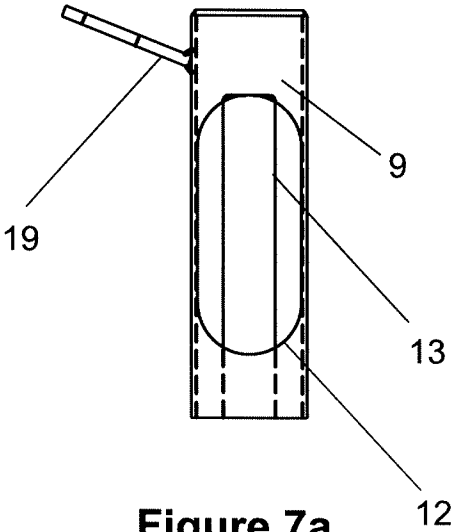
FIG. 7*a* shows a right hand terminal handrail post.
Figure 7B:
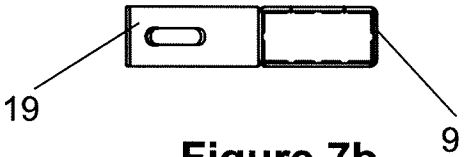
FIG. 7*b* shows a corresponding plan view of the right hand terminal handrail post of FIG. 7*a*.
Figure 7C:
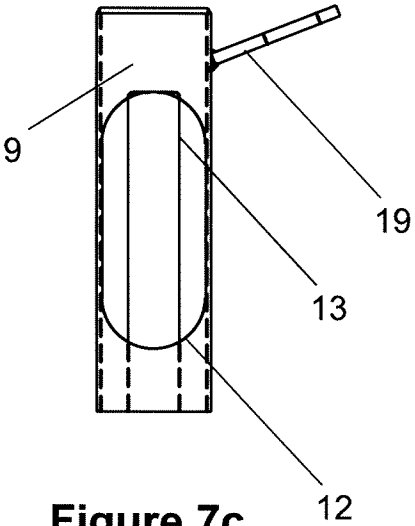
FIG. 7*c* is a left hand terminal handrail post.
Figure 7D:
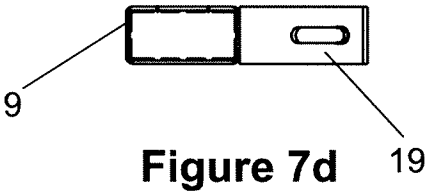
FIG. 7*d* shows a corresponding plan view of the left hand terminal handrail post shown in FIG. 7*c*.
Figure 8A:
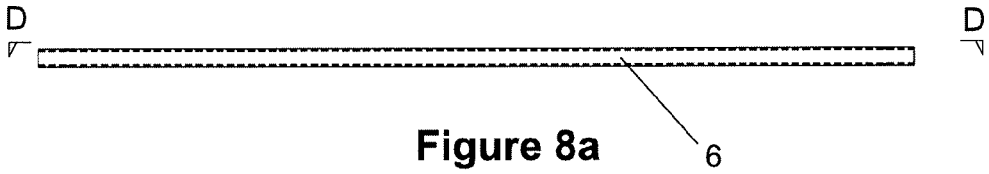
FIG. 8*a* is an elevation view of an intermediate handrail.
Figure 8B:
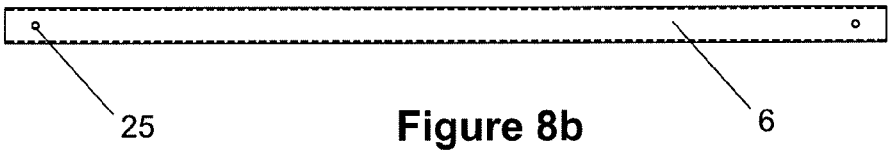
FIG. 8*b* is cross sectional view of the intermediate handrail taken along section line D-D of FIG. 8*a*.

The fence panels may be additionally secured onto the handrail support posts 2 via lugs 18 as shown in FIGS. 5, 6 and 12. Handrail support posts 2 may also include stiffeners 11 attached on either side of the handrail support posts, to provide additional structural support.

Figure 10A:
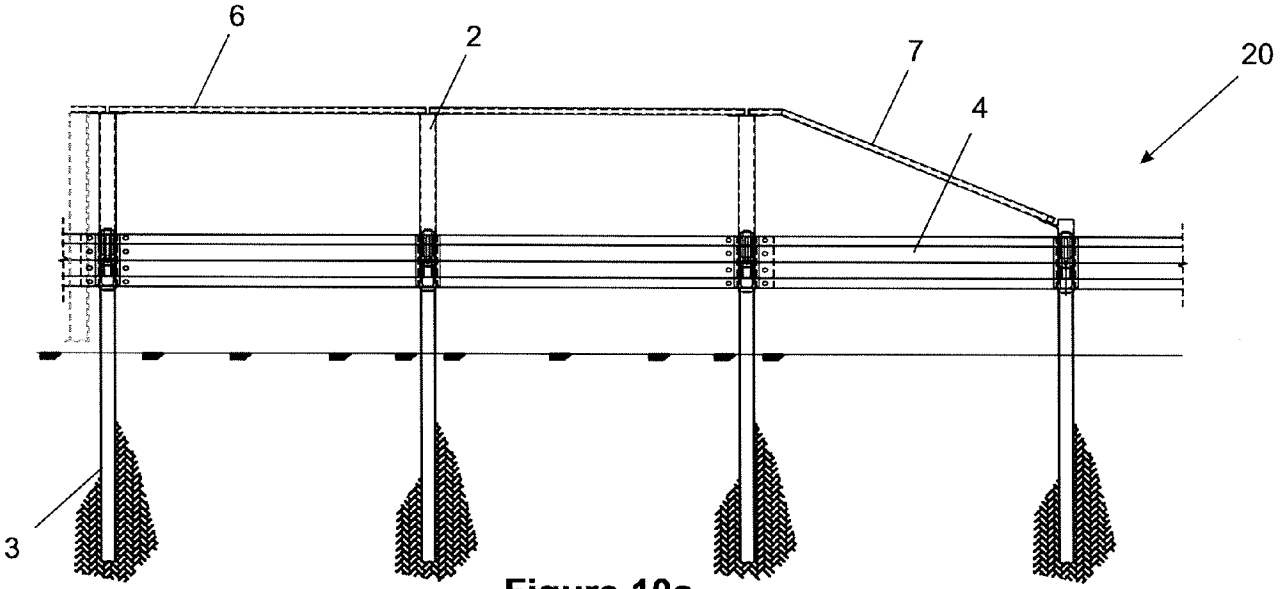
FIG. 10*a* shows an alternative embodiment of the PVB system without fence panels.
Figure 10B:
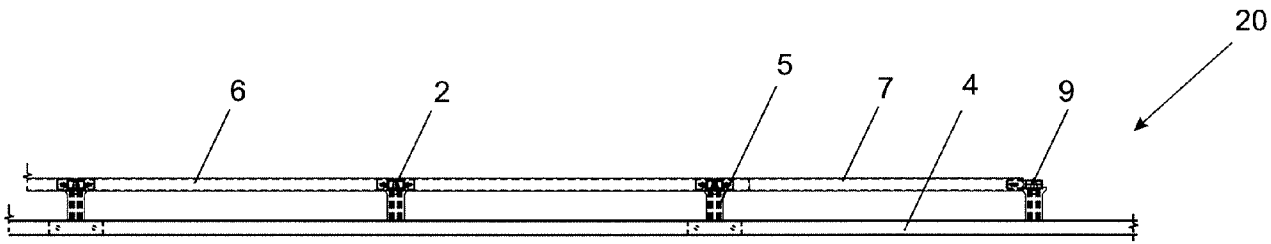
FIG. 10*b* is a corresponding plan view of the embodiment shown in FIG. 10*a*.

In an alternative embodiment shown in FIG. 10, fence panels are not included.

All components of the handrail attachment system 21 are preferably manufactured from galvanized steel. The height of the handrail 6 is preferably approximately 1.4 to 1.5 m above ground level, to suit the average height of pedestrians and/or cyclists utilising the handrail.

The PVB system as described has been designed according to AS/NZS 1170.1:2002 to deflect/dissipate loads of up to 1.5 kN/m. This is sufficient to allow the PVB system to be installed along any road with a speed limit of 70 km/hour.

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope or spirit of the invention.

The invention claimed is:

1. A pedestrian and vehicle barrier comprising:

a vehicle guardrail attached to and supported by at least two guardrail support posts, each guardrail support post comprising an elongate mounting aperture extending longitudinally along a longitudinal axis of the guardrail support post, a pedestrian barrier attached to and supported by at least two pedestrian barrier support posts, each barrier support post comprising:

an elongate member with a wall forming an at least partially closed section, the elongate member having a top end and a bottom end, a slot in the wall located at or adjacent the bottom end and extending longitudinally along a longitudinal axis of the pedestrian barrier support post, an elongated aperture in the wall located adjacent the bottom end of each pedestrian barrier support post and opposite the slot, wherein the bottom end of each pedestrian barrier support post is sleeved around a respective said guardrail support post such that the pedestrian barrier support post cannot be separated from the guardrail support post other than by translation along the direction of the longitudinal axis of the guardrail support post, wherein at least a portion of said elongated aperture is longitudinally aligned with at least a portion of the slot, and at least a portion of the mounting aperture is longitudinally aligned with at least a portion of the slot, a fastener is positioned and received within said portions of the slot, the elongated aperture and said elongate mounting aperture, and wherein the elongated aperture is sized to fit around said fastener, wherein the fastener is slidable along the mounting aperture and said aligned portion of the slot upon impact to the guardrail, wherein the pedestrian barrier support post does not impede the fastener from sliding along the mounting aperture upon impact to the guardrail, wherein the fastener directly or indirectly compresses each pedestrian barrier support post onto a respective said guardrail support post to resist translation of the pedestrian barrier support post along the direction of the longitudinal axis of the guardrail support post, and wherein the vehicle guardrail is translatingly slidable relative to the guardrail support post and the pedestrian barrier support post upon impact to the vehicle guardrail.

2. The pedestrian and vehicle barrier of claim 1, wherein each slot is open ended.

3. The pedestrian and vehicle barrier of claim 2, wherein said pedestrian barrier is at least one fence panel supported by the pedestrian barrier support posts.

4. The pedestrian and vehicle barrier of claim 3, wherein the fence panel includes a series of spaced bars.

5. The pedestrian and vehicle barrier of claim 1, wherein said pedestrian barrier is at least one handrail positioned towards the top end of the pedestrian barrier support posts.

6. The pedestrian and vehicle barrier of claim 1, wherein the fastener comprises a bolt, a nut and a washer.

7. The pedestrian and vehicle barrier of claim 6, wherein, in the assembled state, the washer is positioned within the aperture and substantially in the plane of the wall of the pedestrian barrier support post, and the nut is fastened on the bolt to directly or indirectly bear against wall portions surrounding the slot.

8. The pedestrian and vehicle barrier of claim 6, further comprising a blockout positioned between the vehicle guardrail and each guardrail support post, and wherein, in the assembled state, the elongated aperture is located adjacent the blockout, the washer is positioned substantially within the elongated aperture and substantially in the plane of the wall, and the nut is fastened on the bolt to directly or indirectly bear against wall portions surrounding the slot.

9. The pedestrian and vehicle barrier of claim 1, wherein the guardrail support post below the attachment to the pedestrian barrier support post, is configured to deform upon impact to the vehicle guardrail.

10. The pedestrian and vehicle barrier of claim 1, wherein a portion of the guardrail support post fits within the slot.

11. The pedestrian and vehicle barrier of claim 1, wherein the bottom end of each pedestrian barrier support post is sized to frictionally fit around each guardrail support post.

12. The pedestrian and vehicle barrier of claim 1, wherein the mounting aperture of the guardrail support post is positioned at or adjacent a top end of the guardrail support post.

* * * * *